US009622331B2

(12) United States Patent
Cochran

(10) Patent No.: US 9,622,331 B2
(45) Date of Patent: Apr. 11, 2017

(54) DISCHARGE SWITCH DEVICE FOR IGNITION EXCITATION SYSTEM

(71) Applicant: Unison Industries, LLC, Jacksonville, FL (US)

(72) Inventor: Michael Joseph Cochran, Jacksonville, FL (US)

(73) Assignee: UNISON INDUSTRIES, LLC, Jacksonville, FL (US)

( * ) Notice: Subject to any disclaimer, the term of this patent is extended or adjusted under 35 U.S.C. 154(b) by 313 days.

(21) Appl. No.: 14/018,658

(22) Filed: Sep. 5, 2013

(65) Prior Publication Data

US 2014/0176003 A1 Jun. 26, 2014

Related U.S. Application Data

(60) Provisional application No. 61/745,971, filed on Dec. 26, 2012.

(51) Int. Cl.
*H05B 41/288* (2006.01)

(52) U.S. Cl.
CPC ..... *H05B 41/2881* (2013.01)

(58) Field of Classification Search
CPC ..... H05B 41/2881
USPC ..... 361/253
See application file for complete search history.

(56) References Cited

U.S. PATENT DOCUMENTS 3,445,683 A 5/1969 Traina
3,869,657 A 3/1975 Shoji et al.
3,968,420 A 7/1976 Yoshida
3,984,755 A * 10/1976 Lehnhoff ..... H02H 7/06 322/28
4,256,982 A 3/1981 Bailey
4,613,768 A * 9/1986 Pommer, II ..... H03K 17/30 327/512
4,631,472 A 12/1986 McCollum et al.
4,868,730 A 9/1989 Ward
5,053,913 A 10/1991 Lozito et al.
5,056,497 A * 10/1991 Akagi ..... F02P 3/0453 123/609

(Continued)

FOREIGN PATENT DOCUMENTS

CH 653828 A5 1/1986
DE 3509617 A1 9/1986

(Continued)

OTHER PUBLICATIONS

GB Search Report and Written Opinion issued Jun. 11, 2014 in connection with corresponding GB Patent Application No. GB1322398.7.

(Continued)

*Primary Examiner* — Dharti Patel
(74) *Attorney, Agent, or Firm* — Global Patent Operation-Aviation; William S. Munnerlyn

(57) ABSTRACT

A discharge switch device is provided that includes a comparator portion, a temperature compensation diode, and a trigger portion. The comparator portion is configured to compare an input voltage value to a reference voltage value. The temperature compensation diode is configured to reduce variation of the reference voltage value. The trigger portion is configured to discharge stored energy when the input voltage value exceeds the reference voltage value.

14 Claims, 2 Drawing Sheets

(56) References Cited

U.S. PATENT DOCUMENTS

| | | | | |
|---|---|---|---|---|
| 5,065,073 | A | 11/1991 | Frus | |
| 5,148,084 | A | 9/1992 | Frus | |
| 5,164,615 | A | 11/1992 | Walters | |
| 5,245,252 | A | 9/1993 | Frus et al. | |
| 5,321,389 | A * | 6/1994 | Meister | H02J 9/002 307/10.7 |
| 5,510,952 | A | 4/1996 | Bonavia et al. | |
| 5,592,118 | A | 1/1997 | Wilmot et al. | |
| 5,640,079 | A * | 6/1997 | Nelson | H01M 10/44 320/153 |
| 5,862,033 | A | 1/1999 | Geislinger et al. | |
| 6,353,293 | B1 * | 3/2002 | Frus | F02P 3/0869 123/406.57 |
| 7,095,181 | B2 | 8/2006 | Frus et al. | |
| 7,355,300 | B2 | 4/2008 | Wilmot et al. | |
| 7,880,281 | B2 | 2/2011 | Kempinski | |
| 2003/0039280 | A1 * | 2/2003 | Mangano | H01S 5/0428 372/38.02 |
| 2005/0112420 | A1 * | 5/2005 | Lai | H01M 8/04559 429/432 |
| 2005/0237028 | A1 * | 10/2005 | Denning | H02J 7/0031 320/134 |
| 2007/0274104 | A1 * | 11/2007 | Furukoshi | H02M 1/32 363/16 |
| 2009/0085610 | A1 * | 4/2009 | Westwick | H03K 5/24 327/68 |
| 2010/0263644 | A1 * | 10/2010 | Matsuda | F02P 9/005 123/625 |

FOREIGN PATENT DOCUMENTS

| | | | |
|---|---|---|---|
| FR | 1429616 | A | 2/1966 |
| FR | 1567106 | A | 5/1969 |
| FR | 2143890 | A1 | 2/1973 |
| GB | 1047765 | A | 11/1966 |
| GB | 1177677 | A | 1/1970 |
| GB | 1245825 | A | 9/1971 |
| JP | 5927330 | Y2 | 8/1984 |

OTHER PUBLICATIONS

A French Search Report and Written Opinion issued in connection with corresponding FR Application No. 1362337 on Jul. 29, 2016.

* cited by examiner

DISCHARGE SWITCH DEVICE FOR IGNITION EXCITATION SYSTEM

CROSS-REFERENCE TO RELATED APPLICATIONS

This application claims the priority of Provisional Patent Application Ser. No. 61/745,971, entitled "DISCHARGE SWITCH DEVICE FOR IGNITION EXCITATION SYSTEM", which was filed on Dec. 26, 2012, and is hereby incorporated by reference in its entirety.

BACKGROUND

The field of the invention relates generally to discharge switch devices, and more specifically, to a discharge switch device for ignition excitation system.

At least some known ignition exciters include spark gap switching devices for discharging energy stored in a storage capacitor to an igniter. Such spark gap devices typically include radioactive materials, such as krypton-85 (Kr85) to assist in obtaining consistent ionization levels and uniform operation. As such, environment, health, and safety concerns have recently been raised as to the use of such radioactive materials. As such, there exists no commercially available cost effective and size efficient alternative to such spark gap devices.

Moreover, spark gaps present several disadvantages to the exciter application: (1) they are life limited components; (2) they vary in voltage from spark to spark (+/−100 volts typical); and (3) they vary in break-over voltage during the operational life. Each of these reasons contributes to the ignition system not providing a consistent level of spark energy to the igniter throughout the system life. A significant disadvantage to this characteristic is that it makes it difficult to determine igniter replacement intervals; as each igniter has seen varying levels of discharge stress based on the age and condition of the exciter spark gap.

Breakover diodes have previously been employed to set a trigger voltage to provide gate triggering of thyristor devices. However, these devices have large temperature coefficients and fail to maintain a stable tank voltage over varying temperatures.

BRIEF DESCRIPTION

In one embodiment, a discharge switch device is provided that includes a comparator portion, a temperature compensation diode, and a trigger portion. The comparator portion is configured to compare an input voltage value to a reference voltage value. The temperature compensation diode is configured to reduce variation of the reference voltage value. The trigger portion is configured to discharge stored energy when the input voltage value exceeds the reference voltage value.

In another embodiment, an ignition excitation system is provided that includes an input voltage converter configured to convert input voltage from a power supply into a high-level voltage and a storage capacitor configured to store energy converted by said input voltage converter. The system further includes a discharge switch device that includes a comparator portion, a temperature compensation diode, and a trigger portion. The comparator portion is configured to compare an input voltage value to a reference voltage value. The temperature compensation diode is configured to reduce variation of the reference voltage value. The trigger portion is configured to discharge stored energy when the input voltage value exceeds the reference voltage value.

DRAWINGS

DETAILED DESCRIPTION

The following detailed description illustrates embodiments of the invention by way of example and not by way of limitation. The description clearly enables one skilled in the art to make and use the disclosure, describes several embodiments, adaptations, variations, alternatives, and uses of the disclosure, including what is presently believed to be the best mode of carrying out the disclosure. The disclosure is described as applied to an exemplary embodiment, namely, systems and methods of discharging energy in ignition systems. However, it is contemplated that this disclosure has general application to ignition systems in industrial, commercial, and residential applications.

As used herein, an element or step recited in the singular and preceded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Figure 1:
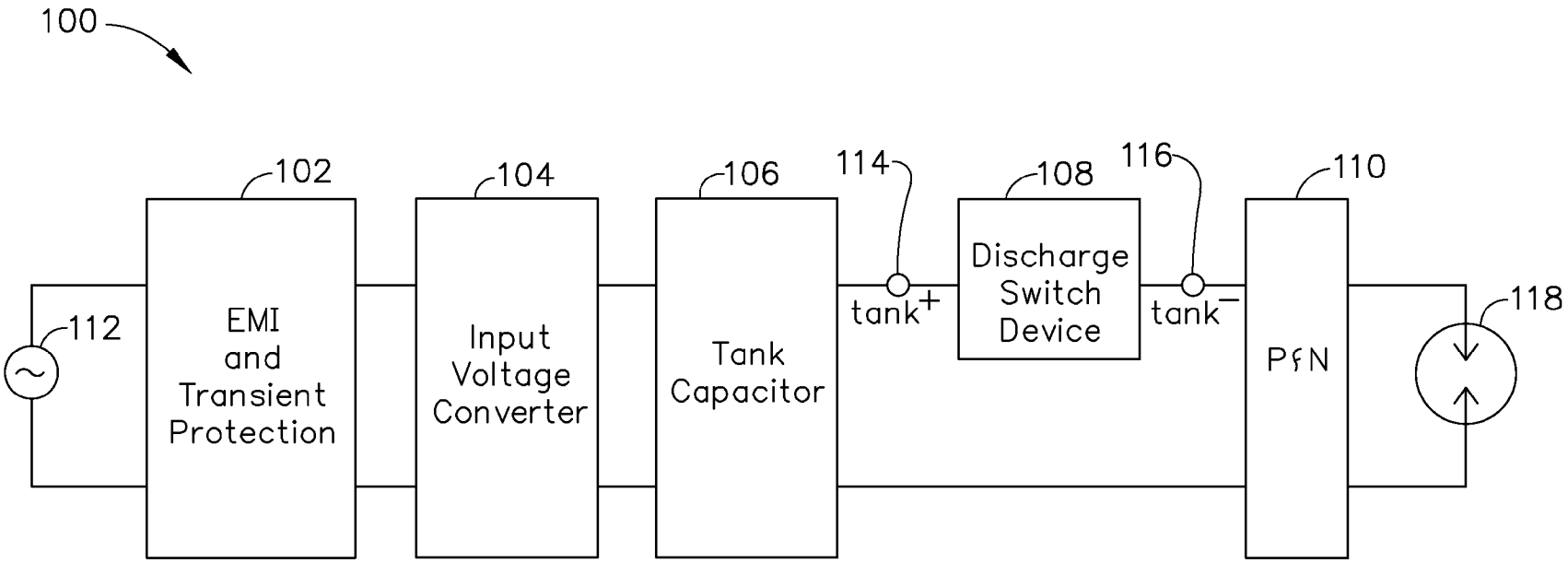
FIG. 1 is a diagram of an exemplary alternating current (AC) ignition exciter circuit.

FIG. 1 is a circuit diagram of an exemplary alternating current (AC) ignition excitation system 100. In the exemplary embodiment, system 100 includes an electromagnetic interference (EMI) filter and transient protection circuitry 102, an input voltage converter 104, a storage ("tank") capacitor 106, a discharge switch device 108, and a pulse forming network 110. System 100 is coupled to a power supply 112 that supplies an AC input voltage. Input voltage converter 104 converts input voltage from power supply 112 into a high-level voltage for storage in tank capacitor 106. Discharge switch device 108 includes "tank$^+$" and "tank$^-$" terminals 114 and 116. Discharge switch device 108 delivers energy stored in tank capacitor 106 from tank$^+$ terminal 114 to tank$^-$ terminal 116, and then onto pulse forming network 110. Pulse forming network 110 amplifies and shapes a discharge pulse, and then delivers the discharge pulse to an igniter 118.

Figure 2:
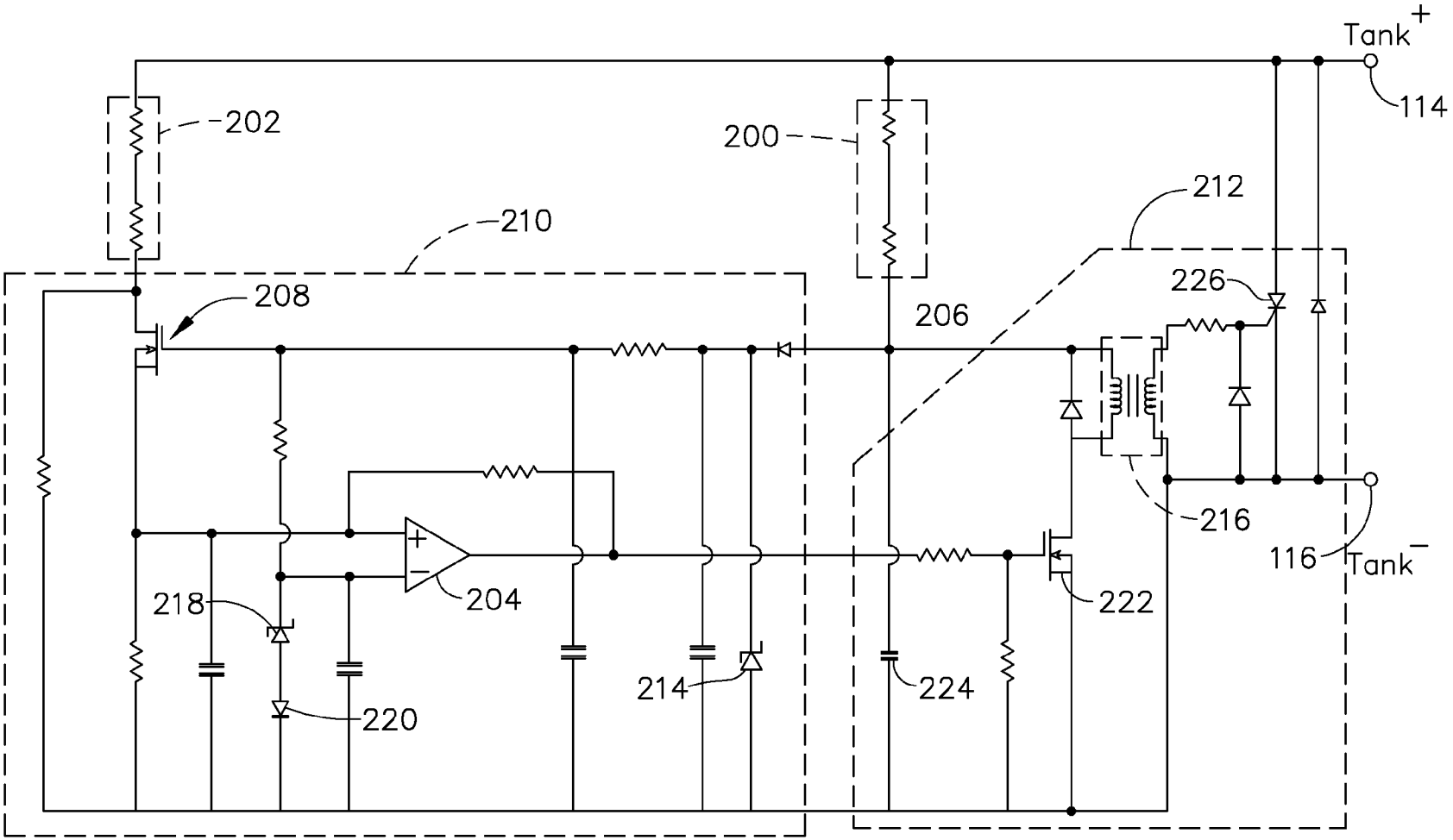
FIG. 2 is an exemplary circuit diagram of the discharge switch device shown in FIG. 1.

FIG. 2 is an exemplary circuit diagram of discharge switch device 108 (shown in FIG. 1). Discharge switch device 108 is a direct replacement for known spark gap switches. In the exemplary embodiment, discharge switch device 108 is coupled to system 100 (shown in FIG. 1) and tank$^+$ and tank$^-$ terminals 114 and 116. Discharge switch device is configured to operate in a temperature range between about −55° Celsius (° C.) and 125° C., and operates during short temperature excursions up to about 150° C.

As tank$^+$ voltage increases in system 100 during an initial charge cycle, current flows through first and second dividers 200 and 202 of discharge switch device 108. First divider 200 charges with tank$^+$ voltage and upon reaching a threshold, is used to supply power to a positive input of a comparator 204. While tank$^+$ voltage increases before reaching the threshold, there is not enough current at a node 206 to power or "awake" comparator 204. During the time before comparator awakes, a metal-oxide-semiconductor field-effect transistor (MOSFET) 208 blocks tank feedback voltage during the initial charge cycle to protect comparator 204 until after input voltage is provided to power comparator 204. For example, MOSFET 208 prevents damage to or early tripping of comparator 204.

In the exemplary embodiment, during the initial charge cycle, discharge switch device 108 pulls a small amount of current (i.e., about 400 μA) to power a comparator portion 210 and a trigger portion 212 of discharge switch device 108. Comparator portion 210 is configured to compare an input voltage value to a reference voltage value. Trigger portion 212 is configured to discharge stored energy when the input voltage value exceeds the reference voltage value. A zener diode 214 sets a positive supply input voltage $V_{cc}$ to comparator 204. Diode 214 also sets a voltage level used to drive trigger portion 212. A reference zener diode 218 sets the reference voltage value for comparator 204.

Comparator portion 210 awakes when tank$^+$ voltage reaches a voltage threshold of approximately 1500 volts on the initial charge cycle. When the voltage threshold is met, diodes 214 and 218 conduct and comparator portion 210 becomes functional.

Diode 220 is provided in series with reference diode 218 as a temperature compensating diode. Temperature compensation diode 220 is configured to reduce variation of the reference voltage value. More specifically, temperature compensation diode 220 is matched to diode 218 to offset the zener voltage change over temperature and provide a stable tank voltage.

Once comparator portion 210 becomes operational, the tank$^+$ feedback voltage is monitored on the positive input of comparator 204 and is compared to a negative input of comparator 204. When the reference level provided to the negative input of comparator 204 by reference diode 218 is exceeded, an output of comparator 204 goes high and transmits a discharge signal to trigger portion 212. In the exemplary embodiment, trigger portion 212 includes a trigger device and a discharge device. The trigger device includes a trigger MOSFET 222 and a trigger transformer 216. More specifically, comparator 204 powers a trigger MOSFET 222. Energy stored in a capacitor 224 is discharged through a primary winding of trigger transformer 216. Trigger transformer 216 outputs a gate trigger pulse to a thyristor 226. In the exemplary embodiment, thyristor 226 is a silicon controlled rectifier. Thyristor 226 conducts and discharges energy stored in tank capacitor 106 (shown in FIG. 1) to pulse forming network 110 (shown in FIG. 1).

The exemplary methods and systems described herein relate to a discharge switch device for an ignition excitation system. More particularly the exemplary embodiments relate to a solid-state spark gap replacement switch device for use in high energy and/or high tension ignition systems. The device may also be used as a "drop-in" replacement that is retrofit for spark gap devices in fielded exciters. The device includes temperature compensation for maintaining a more consistent discharge set point over varying temperatures when compared to spark gap devices.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A discharge switch device comprising:

a comparator portion configured to compare an input voltage value to a reference voltage value;

a temperature compensation diode configured to reduce variation of the reference voltage value; and a trigger portion configured to discharge stored energy when the input voltage value exceeds the reference voltage value, wherein the trigger portion comprises a trigger device and a discharge device and the trigger device comprises a trigger metal-oxide-semiconductor field-effect transistor (MOSFET) and a trigger transformer.

2. A device in accordance with claim 1, wherein said comparator portion is further configured to transmit a discharge signal to said trigger portion when the input voltage value exceeds the reference voltage value.

3. A device in accordance with claim 1, wherein said trigger device is configured to:

switch on said trigger MOSFET when the input voltage value exceeds the reference voltage value; and discharge energy stored in a first storage capacitor through a primary winding of said trigger transformer.

4. A device in accordance with claim 3, wherein said trigger transformer is configured to output a trigger pulse signal to said discharge device.

5. A device in accordance with claim 1, wherein said discharge device comprises a thyristor.

6. A device in accordance with claim 5, wherein said thyristor is configured to discharge the stored energy upon receiving the trigger pulse signal from said trigger transformer.

7. A device in accordance with claim 1, wherein said discharge switch device is a direct replacement for existing spark gap devices.

8. A device in accordance with claim 1, further comprising a voltage protection device configured to protect said comparator portion from feedback voltage during an initial charge cycle.

9. A device in accordance with claim 8, wherein said voltage protection device comprises a MOSFET.

10. A discharge switch device comprising:

a comparator portion configured to compare an input voltage value to a reference voltage value;

a temperature compensation diode configured to reduce variation of the reference voltage value;

a trigger portion configured to discharge stored energy when the input voltage value exceeds the reference voltage value; and a voltage protection device configured to protect said comparator portion from feedback voltage during an initial charge cycle, wherein the voltage protection device comprises a metal-oxide-semiconductor field-effect transistor (MOSFET).

11. A device in accordance with claim 10, wherein said trigger portion comprises a trigger device and a discharge device.

12. A device in accordance with claim 11, wherein said trigger device comprises a trigger metal-oxide-semiconductor field-effect transistor (MOSFET) and a trigger transformer.

13. A device in accordance with claim 12, wherein said trigger device is configured to:

switch on said trigger MOSFET when the input voltage value exceeds the reference voltage value; and discharge energy stored in a first storage capacitor through a primary winding of said trigger transformer.

14. A device in accordance with claim 13, wherein said trigger transformer is configured to output a trigger pulse signal to said discharge device.

* * * * *